US007775800B2

(12) United States Patent
Reischl et al.

(10) Patent No.: US 7,775,800 B2
(45) Date of Patent: Aug. 17, 2010

(54) DEVICE FOR ELECTRONICALLY INTERCONNECTING TWO RELATIVELY ROTATING MEMBERS

(75) Inventors: Erik Reischl, Birkenfeld (DE); Sven Kuerschner, Woellstein (DE); Dieter Kurz, Bacharach/Steg (DE); Peter Leng, Mainz (DE)

(73) Assignee: Delphi Technologies, Inc., Troy, MI (US)

( * ) Notice: Subject to any disclaimer, the term of this patent is extended or adjusted under 35 U.S.C. 154(b) by 30 days.

(21) Appl. No.: 12/082,035

(22) Filed: Apr. 8, 2008

(65) Prior Publication Data

US 2008/0254646 A1 Oct. 16, 2008

(30) Foreign Application Priority Data

Apr. 14, 2007 (EP) ..... 07007654

(51) Int. Cl.
*H01R 39/00* (2006.01)

(52) U.S. Cl. ..... 439/15; 439/164

(58) Field of Classification Search ..... 439/15, 439/16, 164

See application file for complete search history.

(56) References Cited

U.S. PATENT DOCUMENTS 5,230,713 A 7/1993 Schauer
5,286,219 A * 2/1994 Ueno et al. ..... 439/475
5,310,356 A * 5/1994 Obata et al. ..... 439/169
6,116,930 A * 9/2000 Sakata ..... 439/164
6,213,797 B1 * 4/2001 Best et al. ..... 439/164
6,364,676 B2 * 4/2002 Bunselmeier et al. ..... 439/164
6,390,838 B1 * 5/2002 Kawamura ..... 439/164
6,425,779 B1 7/2002 O'Brien, II
6,475,007 B2 * 11/2002 Sugata ..... 439/164
6,854,977 B2 * 2/2005 DuRocher et al. ..... 439/15

FOREIGN PATENT DOCUMENTS

EP 0 556 779 2/1993
EP 1 235 313 8/2002
EP 1 463 164 9/2004

* cited by examiner

*Primary Examiner*—Michael C Zarroli
(74) *Attorney, Agent, or Firm*—Jimmy L. Funke

(57) ABSTRACT

A device for electrically interconnecting two relatively rotating members, such as a vehicle steering wheel and steering column assembly, has a stationary housing portion carried with the steering column assembly and a moving housing portion carried with the steering wheel. A plurality of flexible, electrically conductive wires are spirally wound around the device between the two housing portions. Each conductive wire is guided in a direction-reversing loop formed therein. Each conductive wire is affixed at each of its two respective ends at electrical terminals.

7 Claims, 2 Drawing Sheets

DEVICE FOR ELECTRONICALLY INTERCONNECTING TWO RELATIVELY ROTATING MEMBERS

TECHNICAL FIELD

The present invention relates to an electrical connecting device, in particular for arrangement between the steering wheel and steering column switch module of a motor vehicle, having a stationary housing portion and a housing portion rotatable relative thereto, which in each case carry a terminal unit and surround at least one spirally wound flexible electrical wire which is in each case connected terminally to the terminal units and guided in a direction-changing loop within the housing.

BACKGROUND OF THE INVENTION

Connecting devices of this kind are used in particular for making electrical connections between a current source and a gas collision protection device such as an air bag restraint arranged in the steering wheel dish or steering wheel switches of motor vehicles. Here, a wire arranged between the stator portion and the rotor portion which is rotatable relative thereto has a length such that it can follow the steering deflection, which is about three turns in both directions, wherein during steering wheel deflection the flexible wire expands outwards from a central position in one direction until it abuts against the stator portion and contracts inwards in the other direction until it abuts against the rotor portion. Furthermore it is known that the wire can be assigned positive restraint which is applied to the wire circumferentially and, on rotational movement of the rotor portion, causes predefined winding and unwinding of the wire.

EP 0 556 779 B2 discloses an electrical connecting device having an inner housing and an outer housing which consist of two relatively rotatable components. The connecting device has a flexible and spirally wound transmission medium which is accommodated in a chamber formed by the two housing portions. The transmission medium includes inner and outer ends which are attached to the inner and outer housings respectively, and inner and outer end sections which extend in opposite directions to each other round the circumference of the inner and outer housings, so that between the inner and outer end sections is formed a cable movement-reversing section in which the direction of movement of the transmission medium is reversed. In the chamber formed by the inner and outer housings there are a plurality of flexible cables including at least one transmission cable which serves as a transmission medium and at least one non-transmission dummy cable. Each of the cables has its own inner and outer ends which are attached to the inner and outer housings respectively. The inner and outer end sections of the cables extend in opposite directions to each other round the circumference of the inner and outer housings, so that between the inner and outer end sections are formed cable movement-reversing sections spaced apart at intervals from each other. Furthermore, the inner and outer end sections of the cables are fixed at a distance from each other.

SUMMARY OF THE INVENTION

It is the object of the invention to provide an electrical connecting device of the kind mentioned hereinbefore which ensures the transmission of a plurality of signals with high reliability.

According to the invention, the object is achieved by the fact that at least one additional, spirally wound, flexible electrical wire is provided, which is connected to the terminal units and which is guided in a direction-reversing loop within the housing.

On account of the fact that in the housing are provided two electrical wires which are electroconductively connected to the two terminal units, with the connecting device which works by the so-called short-band technique, the transmission of a plurality of signals is ensured with high reliability. The wiring of the two wires can be for example parallel to each other, that is, redundant, or different current paths of the wires contact different terminal contacts, whereby the number of signals to be transmitted, for example between a motor vehicle's electrical system and a steering wheel, is higher than if a wire is used with the same height of the connecting device.

Appropriately there are provided three additional electrical wires which are coupled to the terminal units.

Preferably the additional wires are wound and connected parallel to the first wire. Thus a total of three wires are available, which are connected to the terminal units parallel to the first wire, guaranteeing a relatively high degree of transmission safety. To achieve functionally favourable winding and unwinding of the wires about a hub of the housing, the direction-reversing loops of the wires are arranged uniformly spaced apart from each other in the housing.

In an embodiment the first wire is welded to pressed screens of the terminal units. Welding achieves a relatively reliable and long-lasting connection which can withstand high loads and yet is relatively cheap to make. To provide a safe terminal connection of the second wire, the second wire is held on socket pins in the welding region of the first wire and comprises a clamping portion which is held by a fixing portion of the terminal unit. According to a development, the fixing portion includes conducting elements to ensure electrical contacting of the first wire and second wire with the associated pressed screen. Naturally the second wire can also be held on the associated terminal unit by the fixing portion without a clamping portion. Preferably, above the fixing portion the third wire and the fourth wire are held in each case on socket pins, located one above the other, the third wire contacting the corresponding pressed screens and the fourth wire contacting the third wire by touch. Electrical contact of the second, third and fourth wires is made by a socket-type, pressed, welded, soldered or adhered connection either to a corresponding pressed screen or current paths of the respectively adjacent wire.

It goes without saying that the characteristics that have been mentioned above and will be described below can be used not only in the given combination, but also in other combinations. The scope of the invention is defined only by the claims.

BRIEF DESCRIPTION OF THE DRAWINGS

The invention is described in more detail below with the aid of a practical example with reference to the associated drawings. They show.

DESCRIPTION OF THE PREFERRED EMBODIMENT

Figure 1:
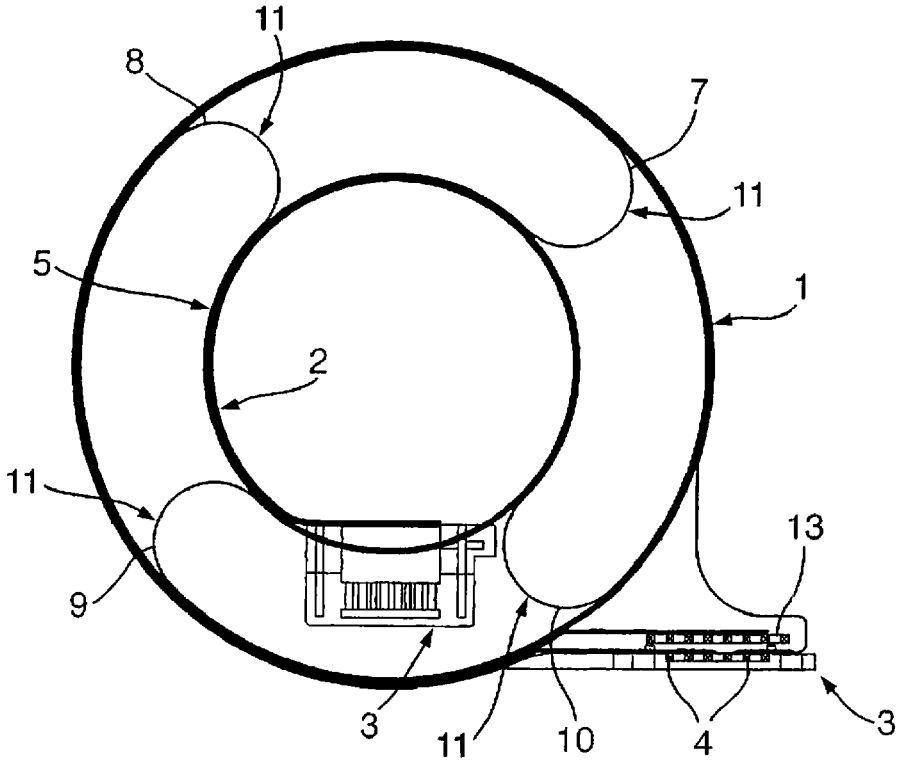
FIG. 1 is a simplified top view of the electrical connecting device according to the invention.
Figure 2:
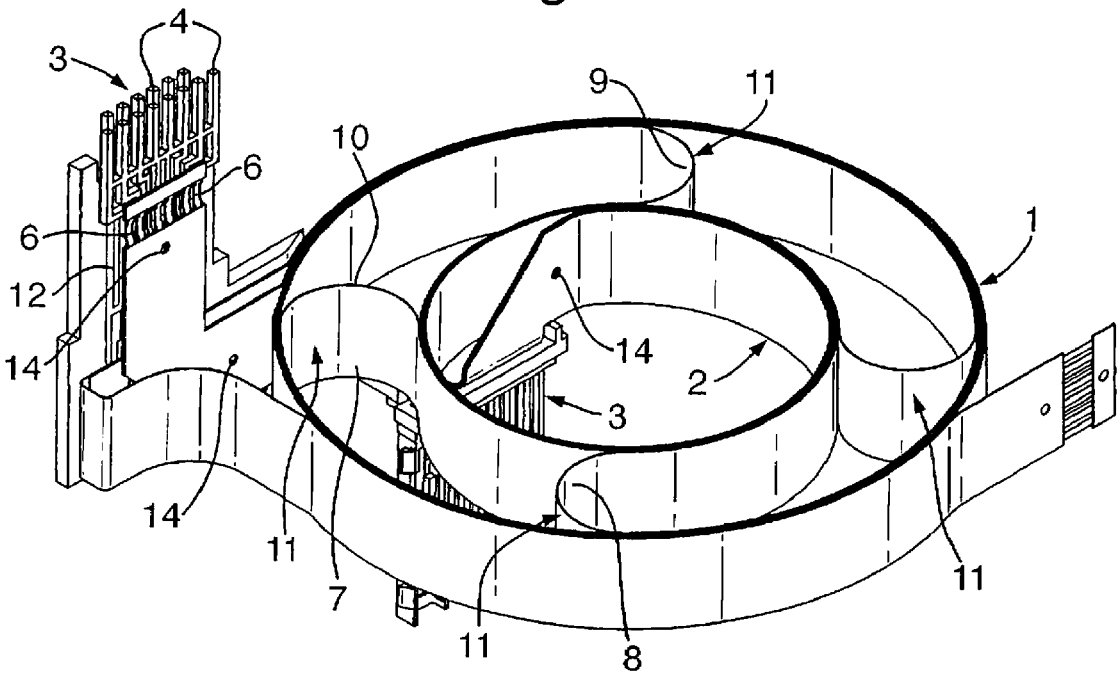
FIG. 2 is a perspective view of the connecting device according to FIG. 1.

Referring to FIGS. 1 and 2, the electrical connecting device embodying the present invention includes a stationary housing portion 1 and a housing portion 2 rotatable relative thereto, which in each case carry a terminal unit 3, the terminal units 3 which comprise terminal contacts 4 being coupled firstly on the stator side to an electrical system of a motor vehicle and secondly on the rotor side to devices on the steering wheel side. Within the two housing portions 1, 2 which form a housing, four wires 7, 8, 9, 10 each comprising several current paths 6 are spirally wound round a hub 5 oriented coaxially with a steering spindle and guided in direction-changing loops 11 within the housing, the loops 11 of the wires 7, 8, 9, 10 being arranged in the housing uniformly spaced apart from each other circumferentially.

For the transmission of electrical signals between the terminal units 3, the first wire 7 is in each case terminally welded to pressed screens 12 of the terminal units 3 comprising the terminal contacts 4. To ensure signal transmission in case of failure of the first wire 7 or provide additional current paths 6 for the transmission of additional signals, the second wire 8 is kept with its free ends in each case in contact with the corresponding pressed screens 12 by a fixing portion 13 of the terminal units 3. Above the fixing portion 13 the third wire 9 and the fourth wire 10 are located one above the other, the fourth wire 10 contacting the pressed screen 12 via the other wires 7, 8, 9. In order to fix the wires 7, 8, 9, 10 to the terminal units 3, socket pins 14 are provided.

Figure 3:
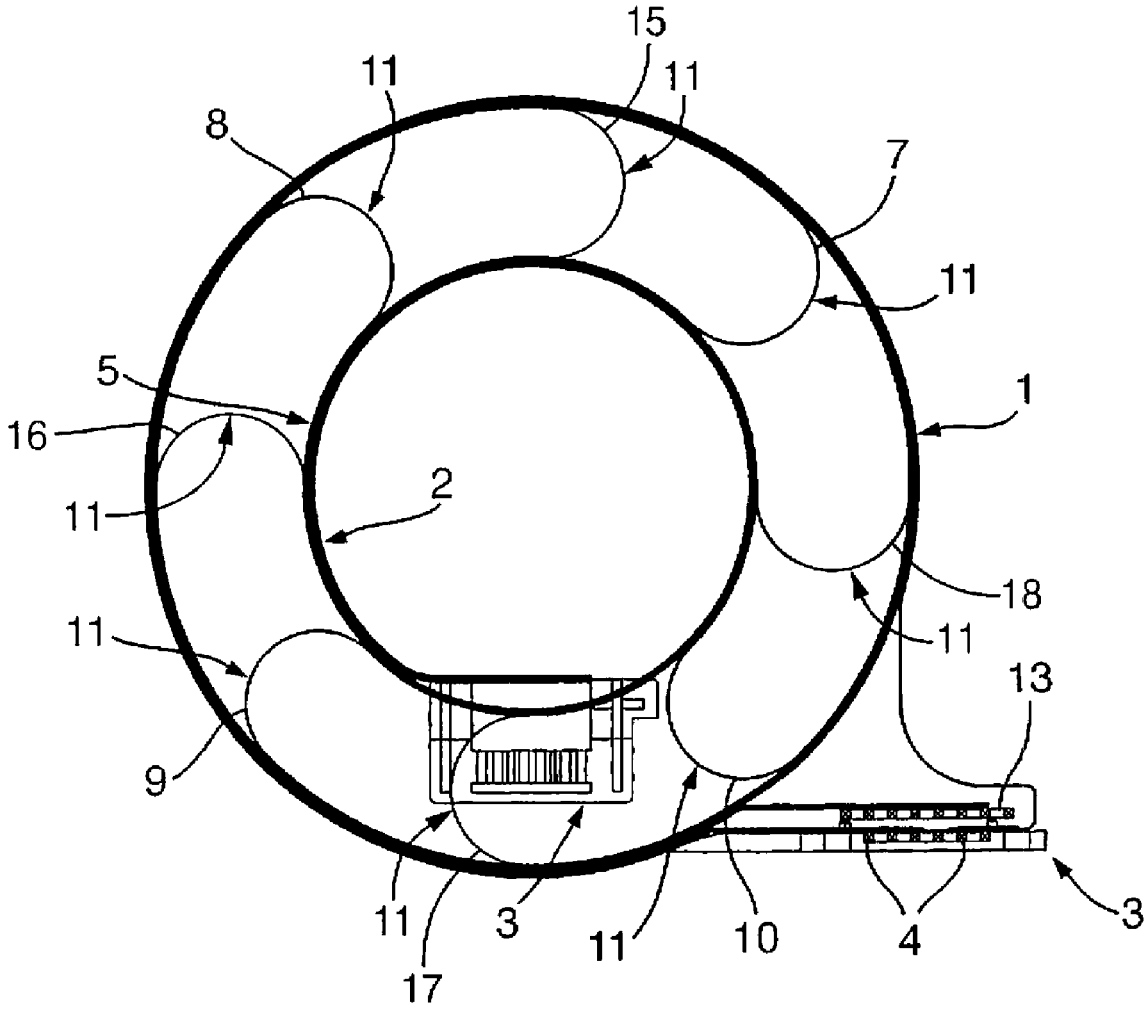
FIG. 3, is a simplified top view of an alternative embodiment of the electrical device according to the invention.

FIG. 3 illustrates an alternative electrical connecting device embodying the present invention in an application similar in all material respects to the embodiment illustrated in FIGS. 1 and 2 with the exceptions set forth herein below. Referring to FIG. 3, the alternative electrical connecting device includes a stationary housing portion 1 and a housing portion 2 rotatable relative thereto, which in each case carry a terminal unit 3, the terminal units 3 which comprise terminal contacts 4 being coupled firstly on the stator side to an electrical system of a motor vehicle and secondly on the rotor side to devices on the steering wheel side. Within the two housing portions 1, 2 which form a housing, eight wires 7, 8, 9, 10, 15, 16, 17, 18, each comprising several current paths 6 are spirally wound round a hub 5 oriented coaxially with a steering spindle and guided in direction-changing loops 11 within the housing, the loops 11 of the wires 7, 8, 9, 10, 15, 16, 17, 18 being arranged in the housing uniformly spaced apart from each other circumferentially.

Referring to FIG. 3, for the transmission of electrical signals between the terminal units 3, the first wire 7 is in each case terminally welded to pressed screens 12 of the terminal units 3 comprising the terminal contacts 4. To ensure signal transmission in case of failure of the first wire 7 or provide additional current paths 6 for the transmission of additional signals, the second wire 8 is kept with its free ends in each case in contact with the corresponding pressed screens 12 by a fixing portion 13 of the terminal units 3. Above the fixing portion 13 the third wire 9 and the fourth wire 10 are located one above the other, the fourth wire 10 contacting the pressed screen 12 via the other wires 7, 8, 9. Similarly, to ensure signal transmission in case of failure of the sixth wire 15 or provide additional current paths 6 for the transmission of additional signals, the seventh wire 16 is kept with its free ends in each case in contact with the corresponding pressed screens 12 by a fixing portion 13 of the terminal units 3. Above the fixing portion 13 the seventh wire 17 and the eighth wire 18 are located one above the other, the eighth wire 18 contacting the pressed screen 12 via the other wires 15, 16, 17. In order to fix the wires 15, 16, 17, 18 to the terminal units 3, socket pins 14 are provided.

The invention claimed is:

1. A device for electrically interconnecting a steering wheel and steering-column switch module of a motor vehicle, said device comprising:

a housing including a stationary housing portion and a displaceable housing portion disposed for relative rotation about an axis with respect to said stationary housing portion:

a first terminal unit fixed with said stationary housing portion;

a second terminal unit fixed with said displaceable housing portion; and at least first, second, third and fourth spirally wound flexible electrical wires, each wire having a first end electrically connected to the first terminal unit and a second end electrically connected to the second terminal unit, each said wire guided in a direction-changing loop within the housing, wherein said wires are circumferentially arranged within said housing and establish a plurality of parallel electrically conductive paths between said first and second terminal units, wherein the second wire is held on socket pins in a welding region of the first wire and comprises a clamping portion which is held by a fixing portion of the terminal unit.

2. The connecting device according to claim 1, wherein the additional wires are wound and connected parallel to the first wire.

3. The connecting device according to claim 1, wherein each said additional wire has a direction-reversing loop, and wherein direction-reversing loops of the wires are arranged uniformly spaced apart from each other in the housing.

4. The connecting device according to claim 1, wherein the first wire is welded to pressed screens of the terminal units.

5. The connecting device according to claim 1, wherein the fixing portion includes conducting elements to ensure electrical contacting of the first wire and second wire with the associated pressed screen.

6. The connecting device according to claim 1, wherein the fixing portion of the third wire and the fourth wire are held in each case on socket pins, located one above the other, the third wire contacting the corresponding pressed screens and the fourth wire contacting the third wire by touch.

7. The connecting device according to claim 1, wherein each wire comprises several, in particular eight current paths, which run parallel to each other between the terminal contacts and which are sheathed in fully insulating relationship, leaving their terminal region free.

* * * * *